US007677788B2

(12) United States Patent
Weiss et al.

(10) Patent No.: US 7,677,788 B2
(45) Date of Patent: Mar. 16, 2010

(54) CURVED BLADE MIXING DEVICE

(75) Inventors: Hans-Jürgen Weiss, Oberursel (DE); Udo Zentner, Griesheim (DE); Burghard Neumann, Hattersheim (DE); Jörg Schmalfeld, Bad Homburg (DE)

(73) Assignee: Lurgi Lentjes AG (DE)

( * ) Notice: Subject to any disclaimer, the term of this patent is extended or adjusted under 35 U.S.C. 154(b) by 1020 days.

(21) Appl. No.: 10/556,648

(22) PCT Filed: Apr. 5, 2004

(86) PCT No.: PCT/EP2004/003578

§ 371 (c)(1),
(2), (4) Date: Feb. 16, 2006

(87) PCT Pub. No.: WO2004/101126

PCT Pub. Date: Nov. 25, 2004

(65) Prior Publication Data

US 2006/0181959 A1 Aug. 17, 2006

(30) Foreign Application Priority Data

May 13, 2003 (DE) ..... 103 21 350

(51) Int. Cl.
*B01F 7/08* (2006.01)

(52) U.S. Cl. ..... 366/97; 366/301; 366/325.3

(58) Field of Classification Search ..... 366/96–99, 366/266, 297–301, 320, 322, 325.3, 326.1, 366/327.1–327.3, 325.1; 422/229; 416/197 R
See application file for complete search history.

(56) References Cited

U.S. PATENT DOCUMENTS 43,227 A * 6/1864 Rankin et al. ..... 366/327.3

(Continued)

FOREIGN PATENT DOCUMENTS

DE 29394 2/1884

(Continued)

OTHER PUBLICATIONS

International Search Report for PCT/EP/2004/003578, dated Jun. 29, 2004; ISA/EP.

*Primary Examiner*—Charles E Cooley
(74) *Attorney, Agent, or Firm*—Harness, Dickey & Pierce, P.L.C.

(57) ABSTRACT

The aim of the invention is to improve an existing mixing device in such a manner that for a predetermined reactor length, retention time is increased and the material which is to be processed is transported at essentially the same speed irrespective of the radial distance thereof from the rotational axis. As a result, at least one row of blades is arranged on each shaft and each row of blades comprises at least two individual blades and the blades are fixed to the shaft at an incidence angle $\alpha$ in relation to the longitudinal axis of the shaft. The blades are curved in themselves, such that the blades form an angle of incidence $\alpha$ at the fixing point on the shaft and an angle of incidence $\beta$ on the outer diameter $D_A$. By virtue of the fact that a row of individual blades is used instead of a continuous screw, efficient mixing of charging material and coke can be achieved, the angle of incidence is reduced from the inside to the outside and the axial speed of the particles which are to be mixed is evened out on the total cross section of the reactor, thereby enabling a stop-type flow to be obtained.

4 Claims, 3 Drawing Sheets

U.S. PATENT DOCUMENTS

Figure 1:
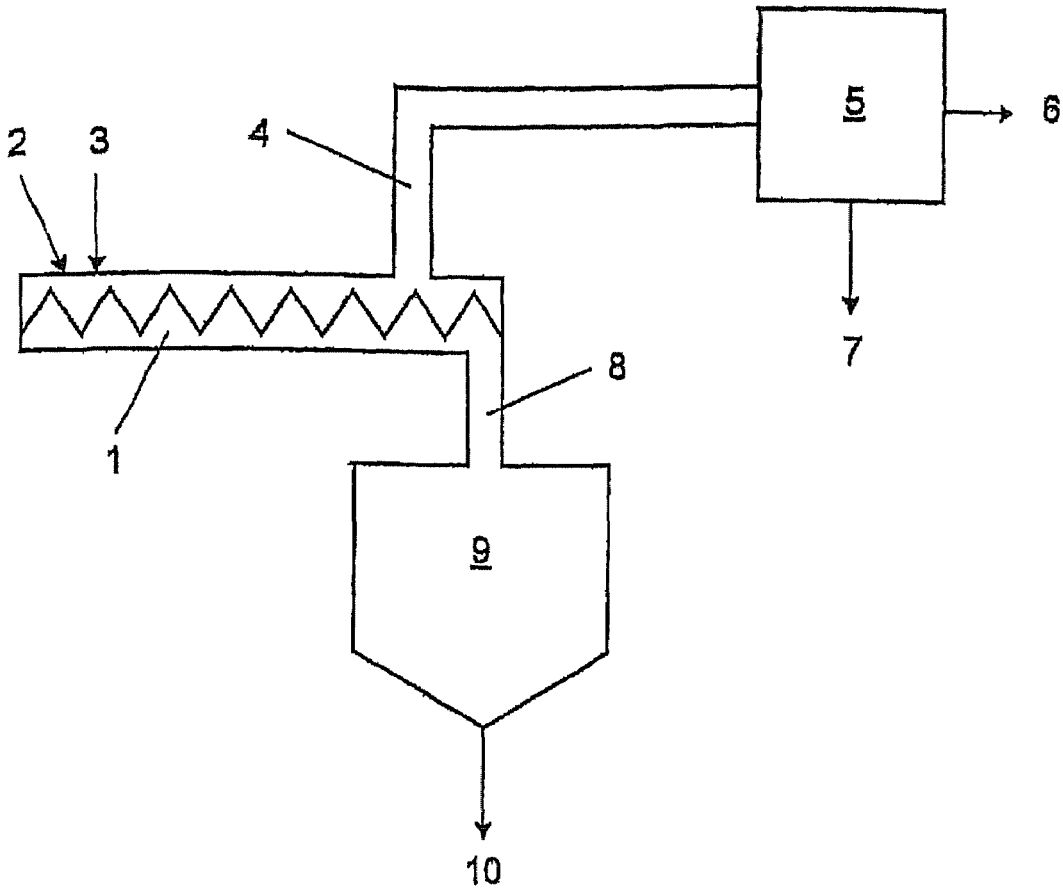

| | | | | | |
|---|---|---|---|---|---|
| 1,590,021 | A | * | 6/1926 | Grace | 366/325.3 |
| 2,017,116 | A | * | 10/1935 | Bonnell | 366/327.4 |
| 3,090,606 | A | | 5/1963 | Burnet | |
| 3,734,469 | A | * | 5/1973 | Goldstein et al. | 366/327.2 |
| 4,344,692 | A | * | 8/1982 | Oda | 399/254 |
| 4,364,667 | A | * | 12/1982 | Reiner | 366/325.3 |
| 4,627,735 | A | * | 12/1986 | Rose et al. | 366/325.3 |
| 4,775,239 | A | | 10/1988 | Martinek et al. | |
| 5,431,860 | A | | 7/1995 | Kozma et al. | |
| 5,519,470 | A | * | 5/1996 | Corrigan, Jr. | 399/256 |
| 5,758,962 | A | * | 6/1998 | Ismar | 366/97 |
| 5,791,779 | A | | 8/1998 | Smith, Sr. | |
| 2006/0176773 | A1 | * | 8/2006 | Ridelle-Berger | 366/293 |
| 2006/0181959 | A1 | * | 8/2006 | Weiss et al. | 366/97 |

FOREIGN PATENT DOCUMENTS

| | | | |
|---|---|---|---|
| DE | 1118959 | | 12/1961 |
| DE | 1 189 368 | | 3/1965 |
| DE | 1 255 098 | | 11/1967 |
| DE | 198 17 518 | A1 | 10/1999 |
| EP | 0 397 894 | A1 | 11/1990 |
| JP | 63-151341 | | 6/1988 |
| WO | WO 9222208 | A1 * | 12/1992 |
| WO | 2004-081841 | | 9/2004 |

* cited by examiner

CURVED BLADE MIXING DEVICE

FIELD

The invention relates to a mixing device as well as to an associated mixing method for the use as continuously working reactor.

BACKGROUND AND SUMMARY

These continuously working reactors are used for the regeneration of for example crude oil vacuum residues, refinery residues, bitumen or plastics by mixing them with a hot granular heat transfer medium and heating them up to the desired temperature.

Usually, mixing devices of this type are composed of at least two horizontally intermeshing screws, which are constructed with different lengths and diameters according to the needs. For obtaining certain properties, such as the increase of the transformation or reaction speed or the maximization of product yield and product quality, the mixing device is varied with respect to the solid retention time, the temperature in the reactor or the system pressure.

DE-A-19724074 and DE-A-19959587 describe a method for the regeneration of residual oil, in which hot coke as heat transfer medium and, via another pipe, the residual oil to be treated are introduced into the mixing device. The heat transfer medium coke has temperatures comprised between 500° and 700° Celsius and is thoroughly mixed with the residual oil by means of at least two horizontal intermeshing screws, such that a uniformly thick oil film is generated on the coke particles. This one is then very quickly heated up to reaction temperature and reacts by forming gases, oil vapours and coke. Gases and vapours leave the mixing device upwards through a drain channel after a short retention time of 1 to 10 seconds.

The coke bearing solid mixture, which has passed through the mixing device and has reached the exit, is evacuated downwards into a buffer tank for further treatment and for post-degasifying.

With mixing devices of this type the attempt is made to achieve an as equal retention time of all solid particles as possible, i.e. a stop-type flow. This means that all such particles which are in the proximity of the shaft are transported with the same axial speed as those particles that are positioned at the outer periphery of the screw. Simultaneously it is tried to set the retention time such that the liquid starting matter will be completely converted into gases, vapours and coke at the end of the mixing device.

Due to the speed profile between conventional shafts and housing wall and the undesired axial mixing, which is related thereto, the particles in these mixing devices have different retention times in the mixing path.

The retention time can be varied by an adaptation of the reactor length, the rotational speed of the shaft, or also the pitch of the screws. In order to use as much of the retention time as possible for the reaction, it is tried to reduce the initial mixing time, i.e. the time which is required to completely mix the heat transfer medium with the liquid starting material. Ideally, a complete mixing takes already place during the introduction of the media at the beginning of the mixing path. But this could not be achieved hitherto. According to the known state of the art, a liquid starting material is completely mixed only after having passed through half the reactor length. In order to increase the retention time, a longer reactor, which could solve the problem, would be an extremely expensive solution, since the shafts and screws are made of high temperature steel and have an outer diameter comprised between 0.8 and 3 m as well as a length comprised between 6 and 15 m.

In order to influence the mean retention time, the pitch and the geometric arrangement of the mixing helixes can be varied. The speed of the solids in the mixing device depends on the pitch and the form of the mixing helix. With increasing pitch of the mixing helix, the axial speed of the solid particles generally decreases and the retention time increases.

Based upon this state of the art, it is object of the invention to improve the former mixing device such that for a predetermined reactor length, the retention time is increased and the material to be processed is transported at essentially the same speed irrespective of the radial distance thereof from the rotational axis.

According to the invention, this aim is achieved for the initially mentioned mixing device in that at least two opposing rows of blades are mounted on each shaft and each row of blades consists of 2 to 20 individual blades and that the blades are fixed to the shaft at an incidence angle $\alpha$ with respect to the longitudinal axis of the shaft, wherein the blades are curved in themselves, such that the blades form the angle of incidence $\alpha$ at the fixing point on the shaft and the angle of incidence $\beta$ on the outer diameter. By virtue of the fact that a row of individual blades is used instead of a continuous screw, a particularly efficient mixing is achieved. Thanks to a curvature of the blades, whereby a different angle of incidence with respect to the longitudinal axis of the shaft results with increasing diameter, the axial speed of the particles to be mixed can be evened out over the entire cross section of the reactor.

By virtue of the fact that the angle of incidence $\beta$ is kept smaller on the outer diameter $D_A$ of the blades than the hitherto usual value of about $2\cdot\alpha$, the axial flow rate becomes more even and, in the ideal case, approaches a stop-type flow. Hereby, a more narrow distribution of the retention time is obtained.

If the angle of incidence of the blades continuously decreases from the base point on the shaft $D_W$ towards the outer diameter $D_A$, the axial speed of the particles to be mixed decreases on the outer diameter $D_A$ proportionally to the axial speed on the diameter $D_W$ of the shaft. On condition that the outer diameter $D_A$ is twice as long as the diameter $D_W$($D_A$=2 $D_W$), the same axial speed will be obtained over the entire cross section of the reactor, if the angle of incidence $\beta$ on the outer diameter $D_A$ is half as great as the angle of incidence $\alpha$ on the diameter $D_W$ of the shaft. The shear effect during the transport of the solids through the mixing device is increased by a multiple interruption of the helix. The mixing intensity is increased and thereby the complete mixing is not only obtained at half the reactor length, but clearly earlier. With the same reactor length, a longer retention time for the chemical reaction is achieved, which enables new plants to have either shorter reactor lengths or alternatively longer reaction times and thus lower reaction temperatures.

Possible realization modes of the mixing shafts are exemplarily illustrated by means of the drawings.

DRAWINGS

Figure 2:
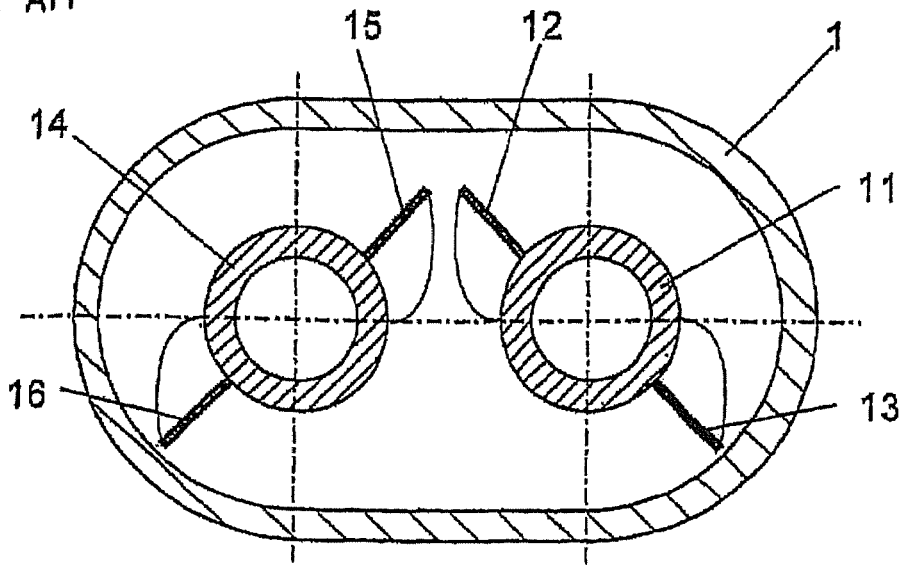
Fig. 2 Prior Art
Figure 3:
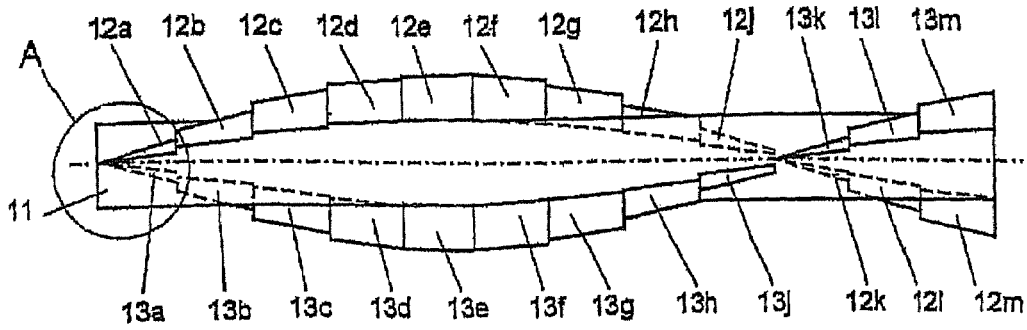
Figure 4:
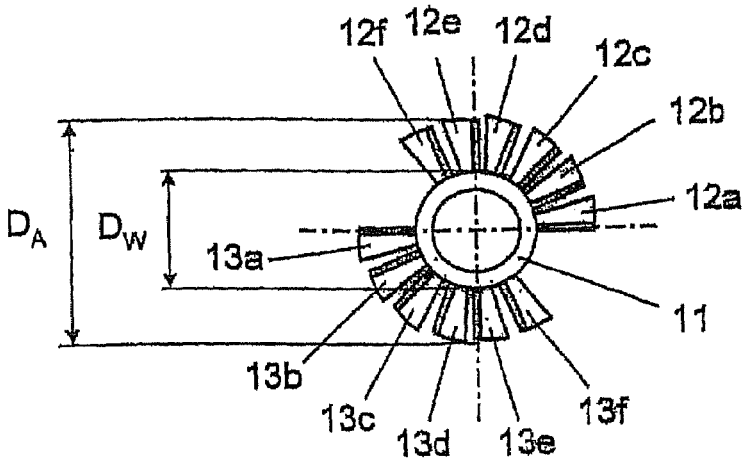
Figure 5:
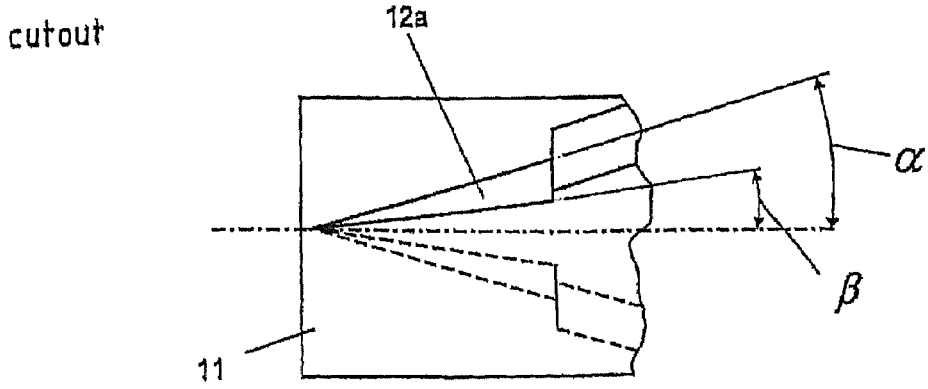
Figure 6:
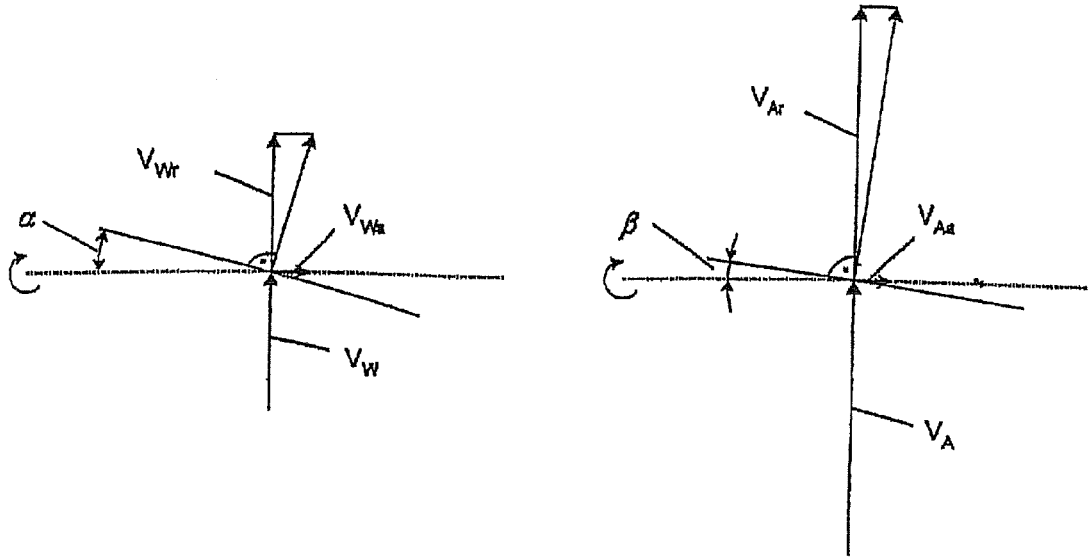
Figure 7:
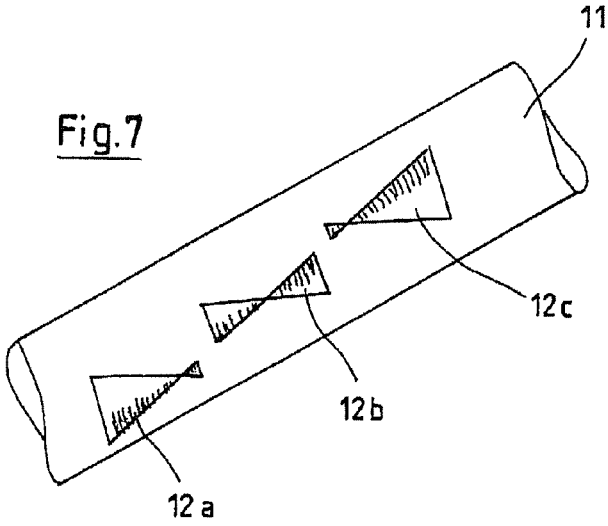

Herein:

FIG. 1 is a flow sheet of the method,

FIG. 2 shows a sectional view through a mixing device according to the state of the art, FIG. 3 shows an individual shaft of a mixing device according to the invention, FIG. 4 is a plan view of the left front of the shaft according to FIG. 3, FIG. 5 is a view of a detail of FIG. 3, FIG. 6 is a representation of the radial and axial speeds acting on a blade, and FIG. 7 is a perspective view of the blades.

DETAILED DESCRIPTION

Hot heat transfer medium coke is for example introduced via pipe (2) into mixing device (1) of FIG. 1 and the residual oil to be processed is introduced via pipe (3). In the present case, mixing device (1) comprises at least two horizontal intermeshing screws, which thoroughly mix the introduced materials and transport them to outlet channel (8). Gases and vapours can leave the mixing device via drain channel (4) for condensation (5). From condensation (5), gases are evacuated via pipe (6) separately from product oil, which is evacuated via pipe (7). The coke bearing solid mixture, which has passed through mixing device (1) is guided via outlet channel (8) to a vessel (9). The dried coke can be evacuated from this vessel (9) via pipe (10) and be returned to the process. Instead of further processing residual oil with heat transfer medium coke, the mixing device can of course also be used for the regeneration of e.g. bitumen, plastics, coke, peat or biomass, whereby the entire plant configuration can change.

FIG. 2 shows a sectional view of a mixing device (1) according to the state of the art. In this mixing device (1), two intermeshing shafts (11, 14) are formed as hollow shafts, which rotate in same direction. Each shaft (11, 14) comprises two screws (12, 13, 15, 16), which continuously extend over the entire length of the shaft. The two screws of a shaft are offset by 180°.

FIG. 3 shows one of at least two shafts used according to the invention. Instead of a continuous screw, a plurality of individual blades (12*a*, 12*b*, 12*c*, . . . 12*m*) are arranged on shaft (11) one after the other in a helical line. A first row of individual blades (12*a*, 12*b*, 12*c*, . . . 12*m*) is associated with a second row of individual blades (13*a*, 13*b*, 13*c*, . . . 13*m*) that is offset by 180° on the shaft. In this representation, each row of blades is composed of 12 individual blades. The term screw or worm like arrangement embraces any regular or irregular arrangement of the blades, which enables the blades (12*a* through 12*m*, 13*a* through 13*m*) to be arranged in a lined up manner on said shaft (11) and which enables said shafts (11, 14) to move on rolling contact to each other without any problems. The number of blades can be varied depending on the reactor length, the diameter relations between shaft and blade and the blade curvatures, which are related thereto. The viscosity or the particle size of the media to be mixed also has an influence, since the mutual distance of the blades can influence the initial mixing time. As with threads, the blades can be arranged in one row or in several rows FIG. 4 is a plan view of the left front of the shaft of FIG. 3. For simplifying matters, respectively six blades (12*a*, 12*b*, 12*c*, . . . 12*f*) and (13*a*, 13*b*, 13*c*, . . . 13*f*) of one row of blades are only represented here. The diameter of shaft (11) at the fixing point of the blades is denominated diameter $D_W$ and the outer diameter of shaft (11) at the blades is denominated diameter $D_A$.

FIG. 5 shows the enlarged cutout "A" of FIG. 3 with the angles of incidence of an individual blade (12*a*). Angle α indicates the angle of incidence of the blade on the shaft. Angle α is associated with diameter $D_W$ of FIG. 4. Angle β is the angle of incidence of blade (12*a*) at the outermost diameter $D_A$. Thus, it is possible to influence the axial speed of the media by means of different angles of incidence of the blades via the cross section of the mixing device. On condition that the outer diameter $D_A$ is double as long as diameter $D_W$, and the angle of incidence remains constantly the same (α=β), the axial speed of the media to be mixed at the outer diameter $D_A$ is double as high as the one at diameter $D_W$ of shaft (11). If the angle of incidence β of the blade at the outer periphery becomes smaller than the angle of incidence α at the fixing point of the blade, the axial speed at the outer diameter $D_A$ decreases to about half the original value. By variation of the angles of incidence α and β in relation to the diameters $D_W$ and $D_A$, the axial speed of the particles can be evened out over the cross section of the mixing device, which results into a more narrow distribution of the retention time. The axial flow thus approaches the desired stop-type flow.

This becomes even more obvious in FIG. 6. For simplification, it is again assumed that the outer diameter $D_A$ of shaft (11) at the blades is double as long as diameter $D_W$ of shaft (11) at the fixing point of the blades→$D_A=2D_W$.

With $D_W$=1.0 m and a constant rotational speed of 20 revolutions per minute, the peripheral speed of the particles at the fixing point of the blades is $V_W$=1.05 m/s. This is thus also the radial speed $V_{Wr}$=1.05 m/s. With an angle of incidence α=16° of the blade at the fixing point on the shaft, an axial speed of the particles of $V_{Wa}$=0.3 m/s results.

With $D_A$=2.0 m and the same rotational speed of 20 revolutions per minute, the peripheral speed of the particles at the outer diameter of the blades is $V_A$=2.09 m/s. This is thus also the radial speed $V_{Ar}$=2.09 m/s. With an angle of incidence β=8° of the blade at the outer diameter $D_A$ of the shaft, the same axial speed of the particles of $V_{Aa}$=0.3 m/s results. The same axial speed of the particles over the cross section of the mixing device can, of course, also be realized with other diameter relations and other angles of incidence.

The invention claimed is:

1. A mixing device, in particular for use as a continuously working reactor, comprising:

at least two rotating shafts (11, 14), wherein at least two opposite rows of blades (12*a*, . . . , 13*a*, . . . , 13*m*) are disposed on each shaft (11, 14) and each row of blades (12*a*, . . . , 13*a*, . . . , 13*m*) includes at least two individual blades, and that the blades are fastened to the shaft (11, 14) at a fastening point along a shaft diameter ($D_W$) at an angle of incidence α to a longitudinal axis of the shaft (11, 14), the blades themselves being curved so that the blades (12*a*, . . . , 13*a*, . . . , 13*m*) exhibit the angle of incidence α at the fastening point on the shaft (11, 14) and an angle of incidence β to the longitudinal axis of the shaft (11, 14) at an outer diameter of the blades ($D_A$) such that the angle of incidence β at the outer diameter of the blade ($D_A$) is less than the angle of incidence α at the shaft diameter ($D_W$), and that the angle of incidence α continuously decreases from the shaft diameter ($D_W$) to the angle of incidence β at the outer diameter of the blade ($D_A$).

2. The mixing device according to claim 1, wherein the outer diameter of the blades ($D_A$) is twice as large as the shaft diameter ($D_W$) and the angle of incidence β is approximately half as large as the angle of incidence α.

3. A method for continuously mixing and reacting liquid or solid feed materials with a solid granular heat-transfer medium in a mixing device, the method comprising:

actuating a mixing device comprising at least two rotating shafts, at least two opposite rows of blades are disposed on each shaft, each of the row of blades having at least two individual blades, each of the individual blades being fastened to the shaft at a fastening point along a shaft diameter ($D_W$) at an angle of incidence α to a longitudinal axis of the shaft, each of the individual blades being curved such that they exhibit an angle of incidence β to the longitudinal axis of the shaft at an outer diameter of the blades ($D_A$) such that the angle of incidence β at the outer diameter of the blades ($D_A$) is less than the angle of incidence α at the shaft diameter ($D_W$), and that the angle of incidence α continuously decreases from the shaft diameter ($D_W$) as the diameter increases and reaches the smaller angle of incidence β at the outer diameter of the blade ($D_A$) such that the axial speed of the liquid or solid feed materials and solid granular heat-transfer medium at the shaft diameter ($D_W$) is equal to the axial speed of the liquid or solid feed materials and solid granular heat-transfer medium at the outer diameter of the blades ($D_A$).

4. A method for continuously mixing and reacting liquid or solid feed materials with a solid granular heat-transfer medium in a mixing device, the method comprising:

actuating a mixing device comprising at least two rotating shafts, at least two opposite rows of blades are disposed on each shaft, each of the row of blades having at least two individual blades, each of the individual blades being fastened to the shaft at a fastening point along a shaft diameter ($D_W$) at an angle of incidence α to a longitudinal axis of the shaft, each of the individual blades being curved such that they exhibit an angle of incidence β to the longitudinal axis of the shaft at an outer diameter of the blades ($D_A$) such that the angle of incidence β at the outer diameter of the blades ($D_A$) is less than the angle of incidence α at the shaft diameter ($D_W$), and that the angle of incidence α continuously decreases from the shaft diameter ($D_W$) as the diameter increases and reaches the smaller angle of incidence β at the outer diameter of the blade ($D_A$) such that the axial speed of the liquid or solid feed materials and solid granular heat-transfer medium at the shaft diameter ($D_W$) is equal to the axial speed of the liquid or solid feed materials and solid granular heat-transfer medium at the outer diameter of the blades ($D_A$), wherein the outer diameter of the blades ($D_A$) is twice as large as the shaft diameter ($D_W$) and the angle of incidence β is approximately half as large as the angle of incidence α.

* * * * *